US011459975B1

(12) United States Patent
Petrariu et al.

(10) Patent No.: US 11,459,975 B1
(45) Date of Patent: Oct. 4, 2022

(54) CYLINDER HEAD HAVING CAST-IN COOLANT PASSAGES ARRANGED FOR PASSIVE IGNITER COOLING

(71) Applicant: Caterpillar Inc., Peoria, IL (US)

(72) Inventors: Viorel Petrariu, Lafayette, IN (US); Jonathan Richard Chittenden, West Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/368,163

(22) Filed: Jul. 6, 2021

(51) Int. Cl.
*F02F 1/36* (2006.01)
*F01P 3/16* (2006.01)
*F02F 1/24* (2006.01)

(52) U.S. Cl.
CPC ..... *F02F 1/36* (2013.01); *F01P 3/16* (2013.01); *F02F 1/242* (2013.01)

(58) Field of Classification Search
CPC ..... F02F 1/36; F02F 1/242; F02F 1/10; F02F 1/40; F02F 2200/06; F01P 3/00; F01P 3/02; F01P 3/12; F01P 3/16; F01P 2003/024
See application file for complete search history.

(56) References Cited

U.S. PATENT DOCUMENTS 1,107,946 A 8/1914 Hesselman
2,647,497 A 8/1953 Stump
8,307,791 B2 * 11/2012 Sugiura ..... F01P 3/02 123/41.62
8,544,450 B2 * 10/2013 Megel ..... F02F 1/242 123/169 CA
8,662,025 B2 * 3/2014 Taki ..... F02F 1/38 123/41.32
8,875,670 B2 11/2014 Brewer et al.
8,904,975 B2 * 12/2014 Ikeda ..... F02F 1/24 123/41.82 R
10,385,800 B2 8/2019 Hyde et al.
2011/0083624 A1 * 4/2011 Megel ..... F02F 1/40 123/193.5
2015/0083058 A1 * 3/2015 Becker ..... F02F 1/242 123/41.79
2016/0047332 A1 * 2/2016 Knudsen ..... F02F 1/40 123/193.5
2018/0223768 A1 * 8/2018 Miura ..... F02F 1/40
2018/0347507 A1 * 12/2018 Hyde ..... F02F 1/242
2019/0195167 A1 * 6/2019 Sakata ..... F02F 1/4285
2019/0211780 A1 * 7/2019 Sakamoto ..... F02F 1/14

* cited by examiner

*Primary Examiner* — Grant Moubry
*Assistant Examiner* — James G Moubry
(74) *Attorney, Agent, or Firm* — Brannon Sowers & Cracraft PC

(57) ABSTRACT

A cylinder head casting in a cylinder head assembly includes a coolant cavity upper surface and a coolant cavity lower surface forming a coolant cavity. The coolant cavity lower surface is contoured to form an igniter-support prominence and cast-in coolant channels through the igniter-support prominence to feed a flow of coolant through a cooling moat extending circumferentially around an igniter post supporting an igniter sleeve. The igniter sleeve abuts the cylinder head, radially outward of the igniter post, at a first contact location and a second contact location in an alternating arrangement with a first coolant feed opening and a second coolant feed opening. Related methodology relating to making a cylinder head is also disclosed.

15 Claims, 5 Drawing Sheets

CYLINDER HEAD HAVING CAST-IN COOLANT PASSAGES ARRANGED FOR PASSIVE IGNITER COOLING

TECHNICAL FIELD

The present disclosure relates generally to a cylinder head for an internal combustion engine, and more particularly to a cylinder head structured for passive cooling of an igniter.

BACKGROUND

Internal combustion engines are well-known throughout the world for purposes ranging from vehicle propulsion to electrical power generation and production of rotational power for diverse purposes such as gas and liquid conveyance and pressurization. Burning of a combustible fuel with air in combustion cylinders in the engine produces a rapid rise in temperature and pressure subjecting components of the engine to mechanical stress and strain, and in most instances requiring active cooling by way of a liquid coolant conveyed through the engine.

In a typical implementation, coolant channels and cavities are formed in engine components to convey a coolant liquid through the engine to dissipate excess heat. A great many different water jacket and related plumbing structures have been proposed over the years in an effort to optimally manage engine temperature.

Depending upon engine type and configuration, an igniter such as a sparkplug, or a prechamber ignition device, is supported in a cylinder head. Such igniters can be sensitive in certain instances to excess temperatures. The complex configuration of an engine head, however, can create challenges in optimally cooling an igniter with liquid coolant, and in some instances ignition problems or structural failures and fatigue can be observed.

In recent years, increased engineering resources have been directed at optimal cooling strategies for igniters supported in an engine head. It has been observed that optimized coolant flow and geometric arrangement of coolant passages can provide operating benefits as well as increased engine power density in some instances. U.S. Pat. No. 10,385,800 is directed to a cylinder head assembly where a coolant passage is cross-drilled through a cylinder head to a cooling moat to provide a pumped flow of coolant into direct heat transference contact with components of the igniter or ignition assembly. While the strategy set forth in the '800 patent undoubtedly has applications, there is always room for improvement and development of alternative strategies.

SUMMARY

In one aspect, a cylinder head includes a cylinder head casting having a cylinder head upper surface, a cylinder head lower surface forming a fire deck, a coolant cavity upper surface, a coolant cavity lower surface, a coolant cavity formed in part by each of the coolant cavity upper surface and the coolant cavity lower surface, and intake conduits and exhaust conduits each extending through the coolant cavity to intake ports and exhaust ports, respectively, formed in the fire deck. The cylinder head casting further has formed therein an igniter bore defining a bore center axis and extending downwardly from the cylinder head upper surface to the coolant cavity upper surface. The coolant cavity lower surface is contoured to form an igniter-support prominence having a radially inward moat surface extending circumferentially around the bore center axis, and a first coolant channel and a second coolant channel each extending radially inward through the igniter-support prominence to the radially inward moat surface.

In another aspect, a cylinder head includes a cylinder head casting having a cylinder head upper surface, a cylinder head lower surface forming a fire deck, a coolant cavity upper surface, a coolant cavity lower surface, and a coolant cavity formed in part by each of the coolant cavity upper surface and the coolant cavity lower surface. The cylinder head casting further includes an igniter bore extending downwardly from the cylinder head upper surface and defining a bore center axis, and the coolant cavity lower surface is contoured to form a first cast-in coolant channel and a second cast-in coolant channel each extending radially inward toward the bore center axis.

In still another aspect, a method of making a cylinder head includes forming, at least in part by casting, a cylinder head having a cylinder head upper surface, and a cylinder head lower surface forming a fire deck, a coolant cavity upper surface, a coolant cavity lower surface, a coolant cavity formed in part by each of the coolant cavity upper surface and the coolant cavity lower surface, and an igniter bore extending from the cylinder head upper surface to the coolant cavity upper surface and defining a bore center axis. The method further includes contouring, by way of the casting, the lower coolant cavity surface to form a first cast-in coolant channel and a second cast-in coolant channel each extending radially inward toward the bore center axis and terminating at coolant feed locations spaced radially outward of the bore center axis.

DETAILED DESCRIPTION

Figure 1:
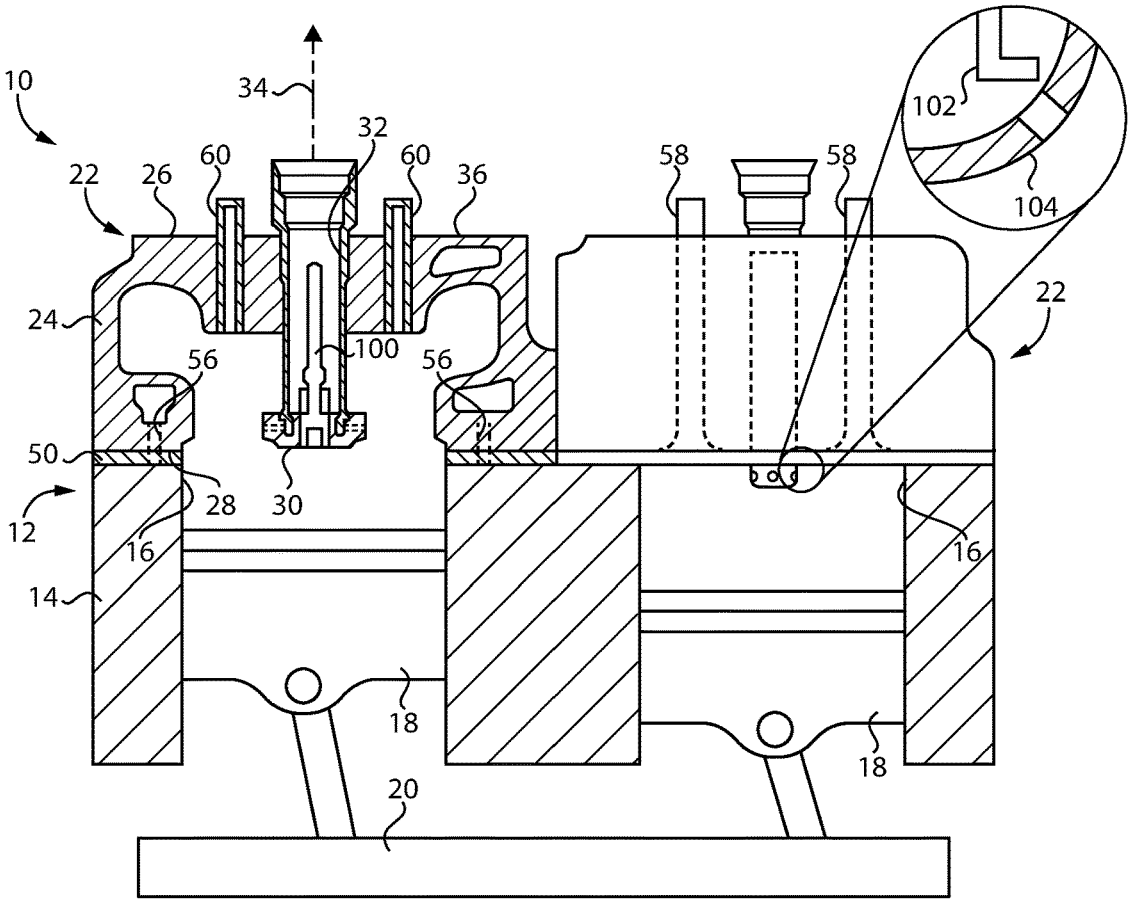
FIG. 1 is a partially sectioned side diagrammatic view of an internal combustion engine system, according to one embodiment.

Referring to FIG. 1, there is shown an internal combustion engine system 10, according to one embodiment. Internal combustion engine system 10 includes an internal combustion engine 12 having a cylinder block 14 with a plurality of combustion cylinders 16 formed therein. A plurality of pistons 18 are each positioned within one of cylinders 16 and moveable in a generally conventional manner to rotate a crankshaft 20. Internal combustion engine system 10 can include a gaseous fuel engine having a gaseous fuel supply (not shown) containing a suitable gaseous fuel such as natural gas, methane, ethane, or various others, stored in a compressed state, a cryogenically liquified state, or fed from a gas line, for example. In other embodiments, internal combustion engine system 10 could include a liquid fuel engine or a dual fuel engine.

Engine 12 further includes a cylinder head assembly 22 having a cylinder head casting or cylinder head 24 with a cylinder head upper surface 26, and a cylinder head lower surface 28 forming a fire deck 30 exposed to cylinders 16. In the illustrated embodiment engine 12 includes a plurality of similar or identical cylinder head assemblies 22 each associated with one combustion cylinder 16. In other embodiments a slab cylinder head could be employed where a single monolithic cylinder head casting is associated with multiple, or all, combustion cylinders in an engine. Combustion cylinders 16 can include any number of cylinders in any suitable arrangement such as an inline pattern, a V-pattern, or still another. Internal combustion engine system 10 may be employed for any purpose such as vehicle propulsion, electrical power generation, or in a compressor application, a pump application, or for a great many other purposes.

Figure 2:
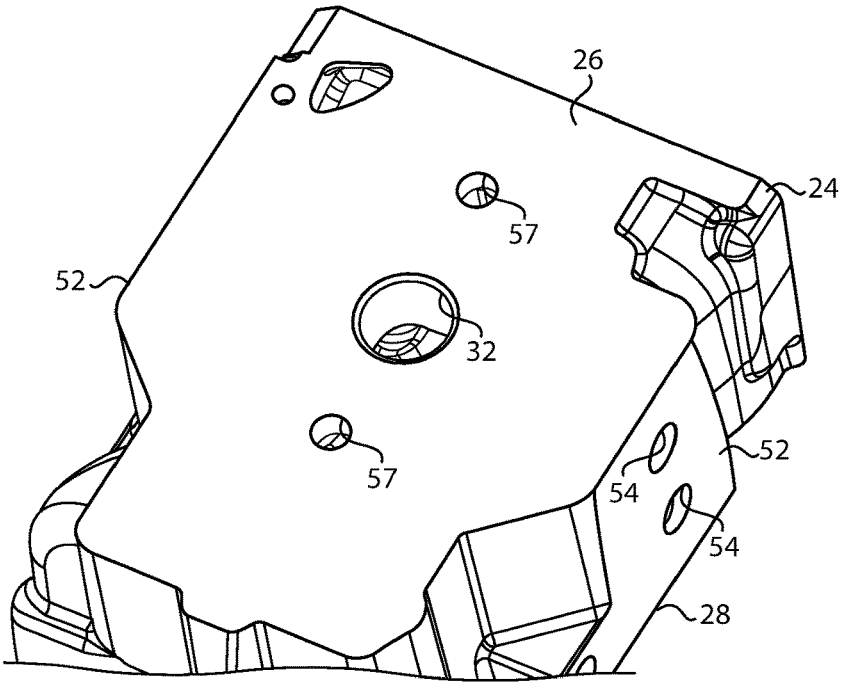
FIG. 2 is a diagrammatic view of a cylinder head, according to one embodiment.

Referring also now to FIG. 2, a head gasket 50, or a plurality of head gaskets, is fitted between cylinder head 24 and cylinder block 14. Cylinder head 24 includes side surfaces 52, at least some of which can include coolant side ports 54 formed therein for conveying coolant to or from an adjacent cylinder head assembly, or to or from a coolant pump or tank, for instance. Coolant lower passages 56 may also be formed in cylinder head 24 to feed coolant to or from cylinder block 14. Coolant upper ports 57 may be formed in cylinder head upper surface 56. Engine valves 58, including at least one exhaust valve and at least one intake valve, and typically two of each, are supported in valve sleeves 60 within cylinder head 24.

Figure 3:
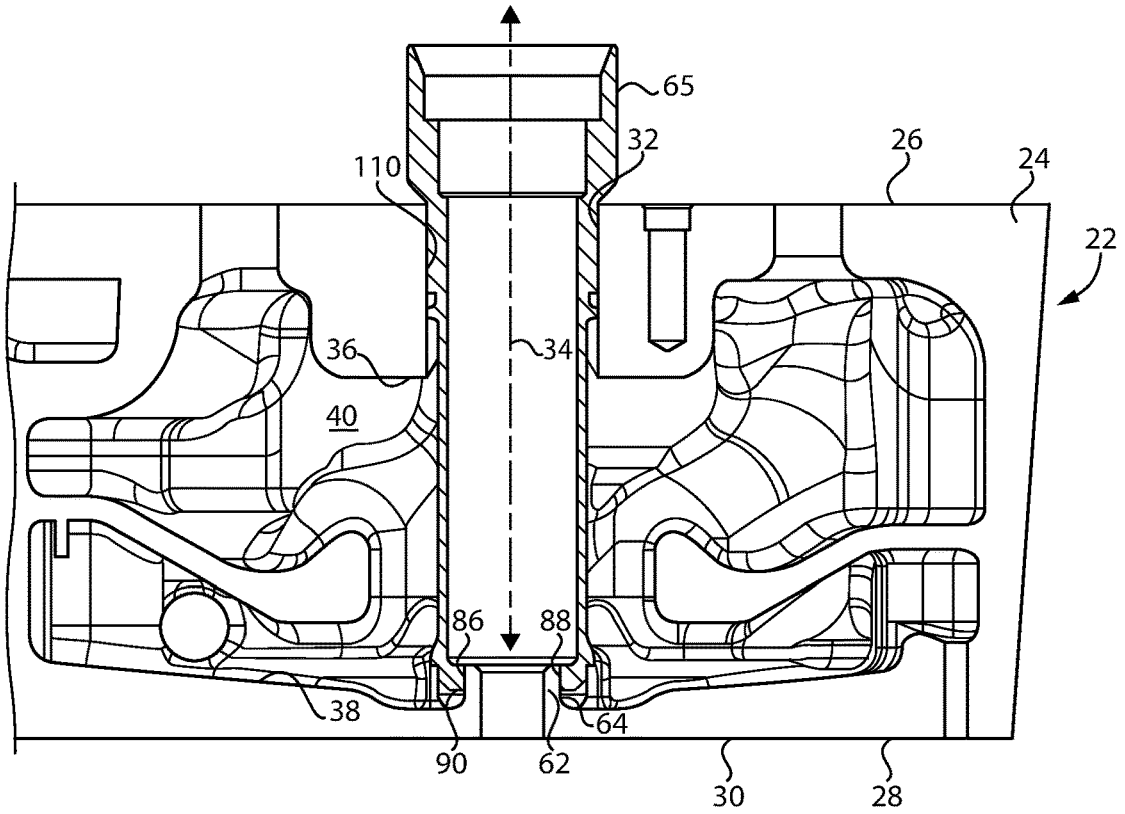
FIG. 3 is a sectioned side diagrammatic view of a cylinder head assembly, according to one embodiment.
Figure 4:
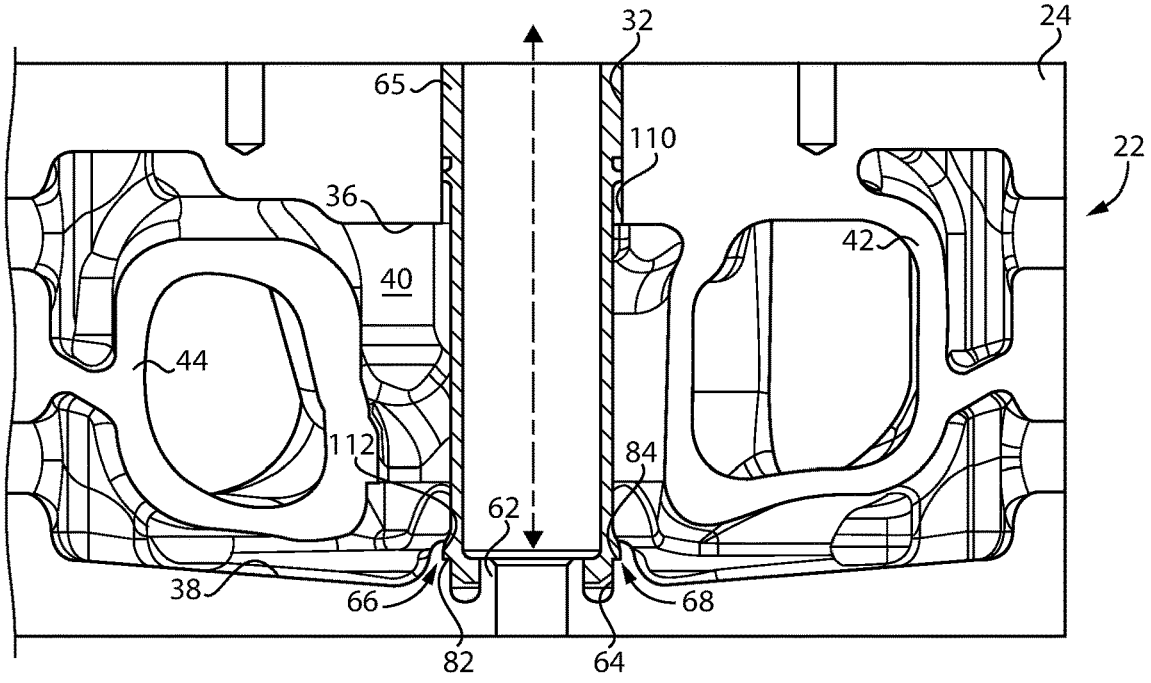
FIG. 4 is another sectioned side diagrammatic view of a cylinder head assembly, according to one embodiment.
Figure 5:
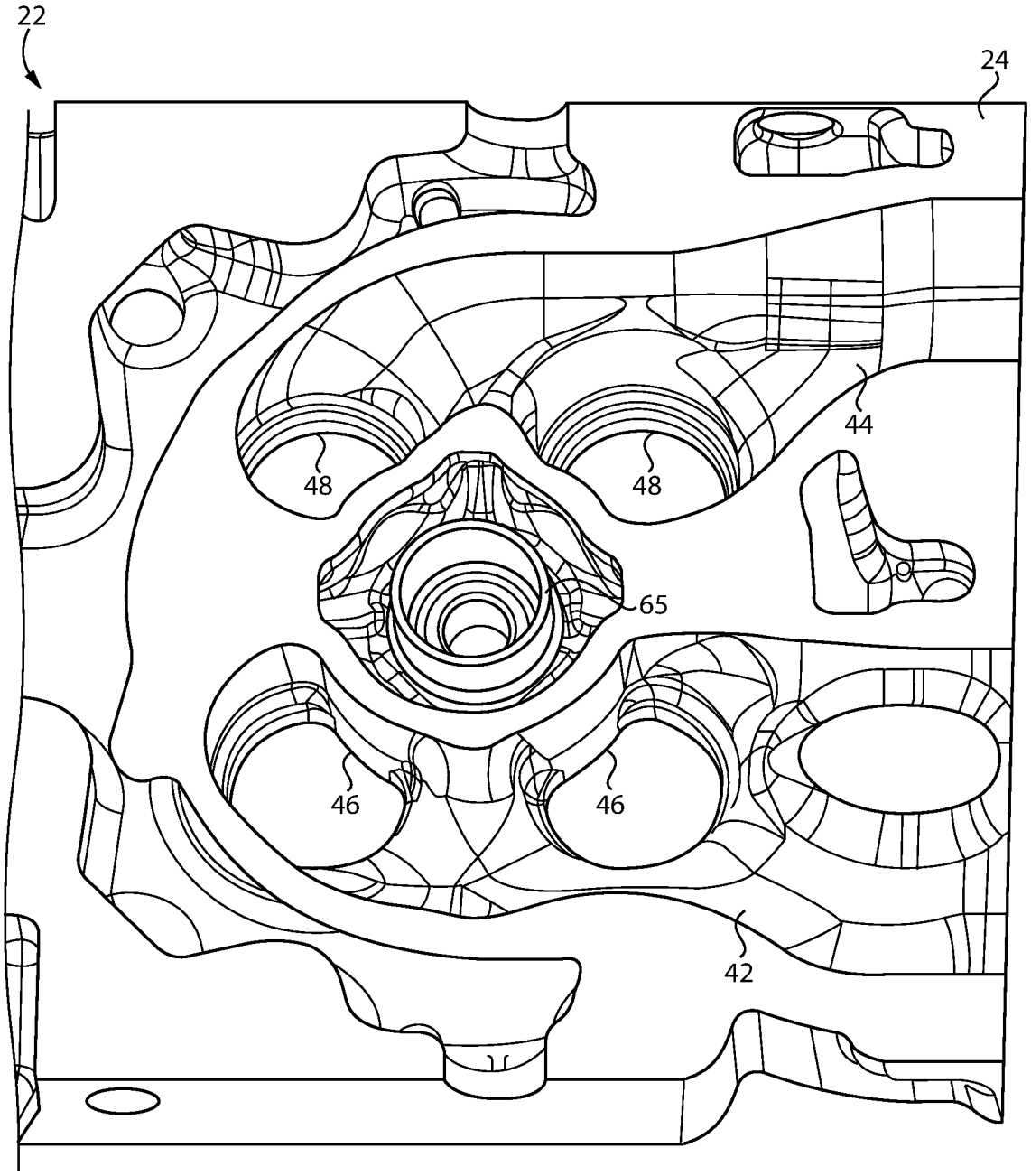
FIG. 5 is yet another sectioned diagrammatic view of a cylinder head assembly, according to one embodiment.

Referring also now to FIGS. 3-5, cylinder head 24 further includes a coolant cavity upper surface 36, a coolant cavity lower surface 38, and a coolant cavity 40 formed in part by each of coolant cavity upper surface 36 and coolant cavity lower surface 38. Cylinder head 24 further includes intake conduits 42 and exhaust conduits 44 each extending through coolant cavity 40 to intake ports 46 and exhaust ports 48, respectively, formed in fire deck 30. In the illustrated embodiment each of intake conduits 42 are formed by a single incoming intake conduit that is divided into two conduits to provide a flow of intake air, and potentially intake air and gaseous fuel, or intake air, gaseous fuel and recirculated exhaust gas, for instance, to intake ports 46. Exhaust conduits 44 may also be formed from a single outgoing conduit that is divided at exhaust ports 48 and merges to form a single outgoing flow of exhaust to an exhaust system (not shown). Coolant cavity 40 may extend peripherally around intake conduits 42 and exhaust conduits 48 within cylinder head 24. The incoming connection to intake conduits 42 and the outgoing connection to exhaust conduits 44 can be formed in side surfaces of cylinder head 24.

Cylinder head 24 may further include an igniter post 62, and a cooling moat 64 extending circumferentially around igniter post 62. Cylinder head assembly 22 may further include an igniter sleeve 65 within an igniter bore 32 and mounted to igniter post 62. Igniter bore 32 extends downwardly from cylinder head upper surface 56 to coolant cavity upper surface 36. Igniter sleeve 65 includes a sleeve inner surface 88. Igniter post 62 is coaxially arranged with igniter bore 32. Cylinder head assembly 22 may also include a sparkplug igniter 100 supported in igniter sleeve 65 and including one or more spark electrodes 102 extending through an igniter opening 63, coaxially arranged with igniter bore 32, as further discussed herein.

Figure 6:
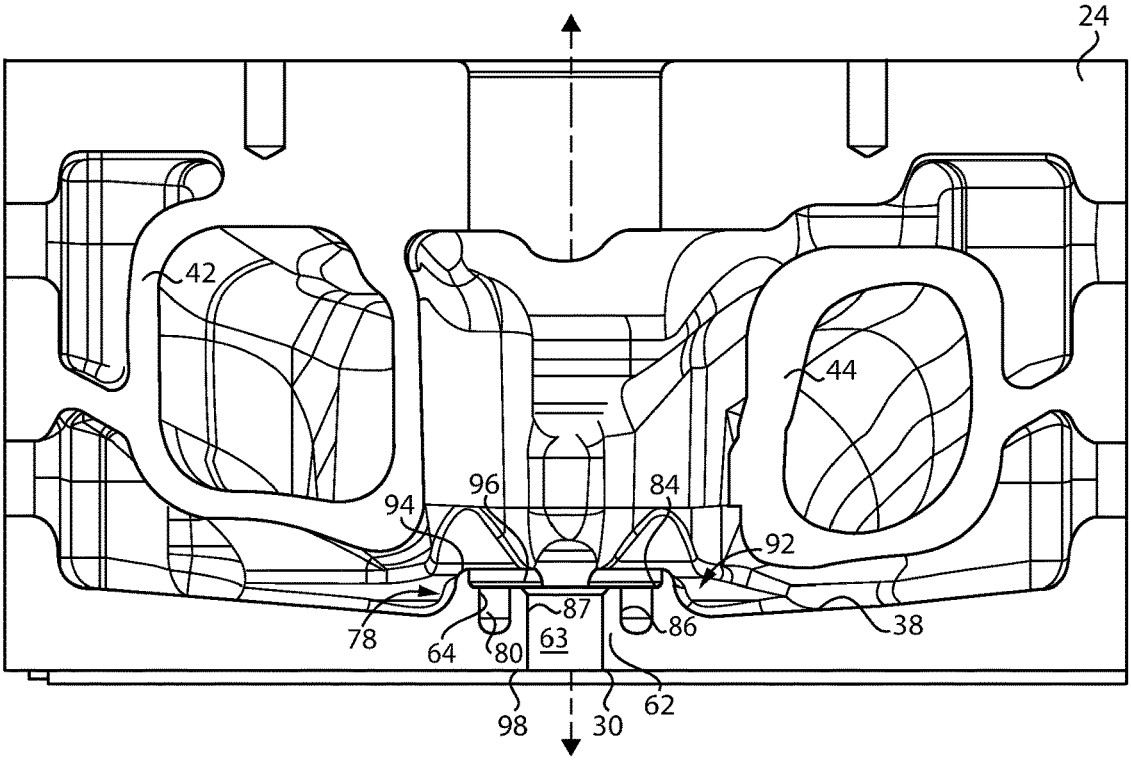
FIG. 6 is a sectioned side diagrammatic view of a cylinder head, according to one embodiment.
Figure 7:
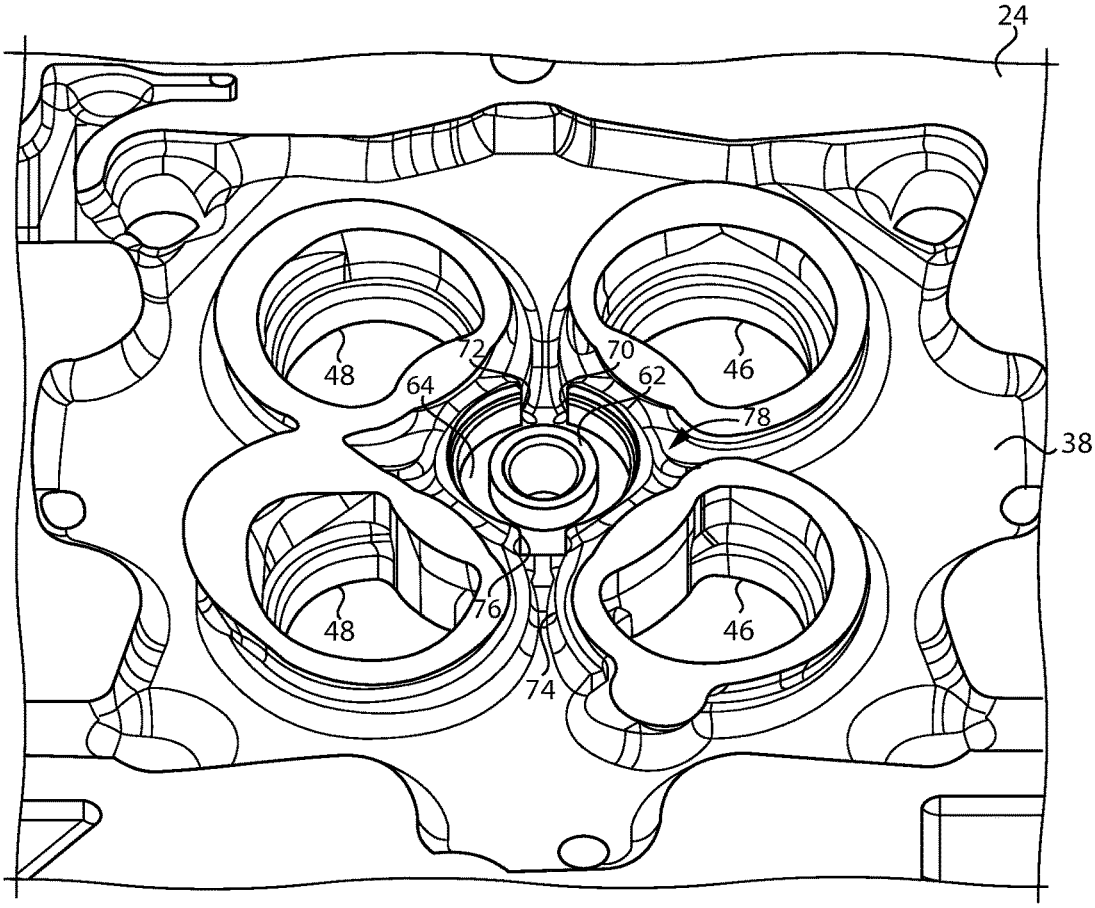
FIG. 7 is another sectioned diagrammatic view of a cylinder head, according to one embodiment.
Figure 8:
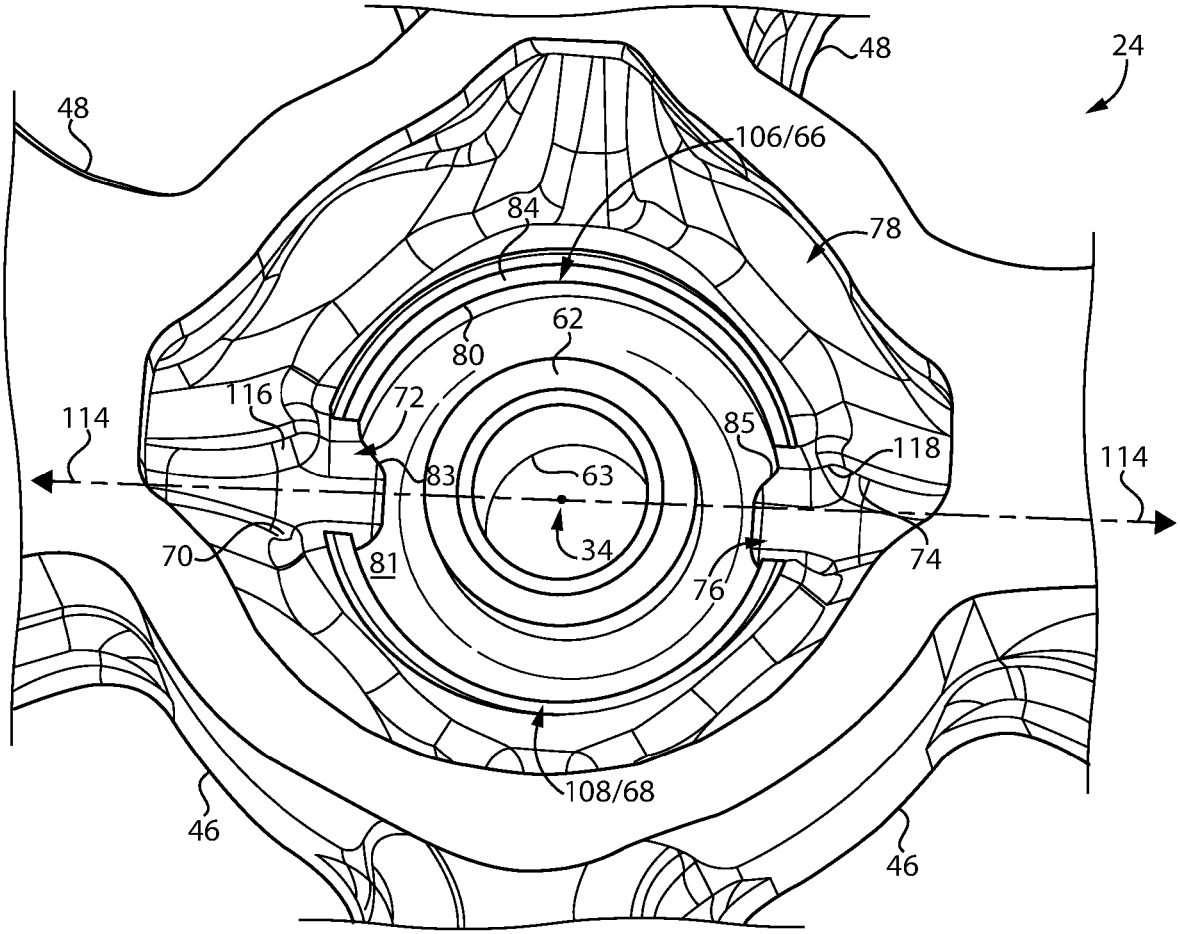
FIG. 8 is yet another sectioned diagrammatic view of a cylinder head, according to one embodiment.

Referring also now to FIGS. 6-8, igniter post 62 may extend upwardly to igniter bore 32 and includes a post outer surface 86 and a post inner surface 87 forming igniter opening 63. Sleeve inner surface 88 is interference-fitted with post outer surface 86. Igniter post 62 may be centrally located in cylinder head 24 and defines an igniter opening axis, also labeled with reference numeral 34, extending between a first post axial end 96 and a second post axial end 98 including a fire deck surface (not numbered) that forms a part of fire deck 30. References herein to "axis 34" should be understood to refer to "bore center axis 34" and "igniter opening axis 34" interchangeably. Post outer surface 86 may form a wetted inner wall of cooling moat 64, with igniter opening 63 extending between igniter bore 32 and fire deck 30. In the illustrated embodiment internal combustion engine system 10 is prechamber spark-ignited. As shown in the detailed enlargement of FIG. 1, a spark electrode 102 may be within a prechamber 104 and produces an electrical spark when energized that ignites a gaseous fuel and air within prechamber 104 to produce hot jets of combusting gases that advance outwardly from prechamber 104 to ignite a main charge of gaseous fuel and air in a corresponding one of combustion cylinders 16.

Igniter post 62 may be part of an igniter cooling structure 92 for cylinder head 24. Igniter cooling structure 92 may include a body 94 that is part of cylinder head 24, or part of a separate piece inserted into cylinder head 24. Body 94 and cylinder head 24 may further include a radially inward moat surface or moat wall surface 80 extending circumferentially around axis 34 and forming, together with post outer surface 86, cooling moat 64.

Igniter bore 32 fluidly connects to coolant cavity 40 in the illustrated embodiment, and may include an upper bore section 110 originating at cylinder head upper surface 26 and terminating at coolant cavity lower surface 36. Igniter bore 32 may also include a lower bore section 112 originating at a moat peripheral surface 84 and facing an axial direction away from fire deck 30. Igniter sleeve 65 may include a shoulder surface 82 facing an axial direction of fire deck 30. Igniter sleeve 65 may abut cylinder head 24 at moat peripheral surface 84, radially outward of igniter post 62, at a plurality of contact locations. In an embodiment, igniter sleeve 65 abuts cylinder head 24 at moat peripheral surface 84, radially outward of igniter post 62, at a first contact location 66 and at a second contact location 68 angularly spaced from first contact location 66.

Cylinder head 24 further has formed therein a first coolant channel 70 opening to cooling moat 64 at a first coolant feed location formed by a first coolant channel opening or first coolant feed opening 72 that is angularly between first contact location 66 and second contact location 68, circumferentially around axis 34. Cylinder head 24 may further have formed therein a second coolant channel 74 opening to cooling moat 64 at a second coolant feed location formed by a second coolant channel opening or second coolant feed opening 76 angularly between first contact location 66 and second contact location 68, circumferentially around axis 34. First coolant feed opening 72 and second coolant feed opening 74 may be arranged opposite one another about axis 34 and each extending from moat peripheral surface 84 to a moat floor 81. As noted above, igniter sleeve 65 may include shoulder surface 82 abutting against moat peripheral surface 84. The abutment of igniter sleeve 65 and cylinder head 24 may include metal-metal contact (direct abutment) of shoulder surface 82 to moat peripheral surface 84. In other embodiments, a sealing ring or the like could be coupled to igniter sleeve 65 and positioned between the interfacing surfaces. The abutment of igniter sleeve 65 and cylinder head 24 confines within cooling moat 64 a flow of coolant between first coolant channel 70 and second coolant channel 74. Shoulder surface 82 may be continuous circumferentially around axis 34, and moat peripheral surface 84 may be discontinuous and interrupted at the first coolant feed location of first coolant feed opening 72 and at the second coolant feed location of second coolant feed opening 76.

It can further be seen from FIG. 8 that first contact location 66 is at a first angular orientation circumferentially around axis 34, and second contact location 68 is at a second angular orientation circumferentially around axis 34. Moat peripheral surface 84 may form a first circular arc from first coolant feed opening 72 to second coolant feed opening 76, and a second circular arc opposite to the first circular arc extending from second coolant feed opening 76 to first coolant feed opening 72. Accordingly, when igniter sleeve 65 is installed in igniter bore 32 moat peripheral surface 84 forms a stop for igniter sleeve 65, and igniter sleeve 65 contacts moat peripheral surface 84 to form a first sealing arc 106 that includes first contact location 66 and a second sealing arc 108 that includes second contact location 68. Sealing arcs 106 and 108 might or might not be liquid-tight, but will form fluid "seals" sufficient to confine within cooling moat 64 the flow of coolant as described herein. It can also be noted from the drawings that the first coolant feed location and the second coolant feed location are spaced 180° apart around axis 34 and in an alternating arrangement with first sealing arc 106 and second sealing arc 108. Given that each of first coolant feed opening 72 and second coolant feed opening 76 defines some angular range circumferentially around axis 34 it will be appreciated a center-to-center angular range between first coolant channel 70 and second coolant channel 74 might be somewhat more or somewhat less than 180°. Coolant channel openings 72 and 76 may be spaced 180° apart around axis 34 in conformity with the arrangement of the respective coolant feed locations and first coolant channel 70 and second coolant channel 74. First coolant channel 70 and second coolant channel 74 and the corresponding first coolant feed opening 72 and second coolant feed opening 76 may each be one of a total of two coolant channels and a total of two coolant feed openings, respectively, to cooling moat 64 in cylinder head 24. It can also be noted from the drawings that cooling moat 64 may have a U-shape in cross-section. Igniter sleeve 65 includes a sleeve axial tip 70 exposed to cooling moat 64.

It can further be seen from the drawings that moat surface 80 includes a moat floor or moat floor surface 81. First coolant channel 70 and second coolant channel 74 terminate, respectively, at first coolant feed opening 72 and second coolant feed opening 76. Moat surface 80 may include a machined wall surface, with each of first coolant feed opening 72 and second coolant feed opening 76 being formed at least in part in the subject machined wall surface. A first machined edge 83 and a second machined edge 85 are each formed in part in each of the machined wall surface of moat surface 80 and in part in moat floor surface 81 and define first coolant feed opening 72 and second coolant feed opening 76, respectively. First coolant channel 70 and second coolant channel 74 may be arranged along a common axis 114 intersecting axis 34. First coolant channel 70 may form a first tapered throat 116 enlarged in a radially inward direction and second coolant channel 74 forms a second tapered throat 118 enlarged in an opposite radially inward direction. Each of first coolant channel 70 and second coolant channel 74 may include an open or open-roofed channel, thus open in an axial direction away from fire deck 30.

It will be appreciated from the foregoing description that cylinder head 24 includes a number of internal structures and shapes that assist in feeding coolant around igniter post 62 to dissipate heat from spark plug igniter 100, igniter sleeve 65, and proximate locations of fire deck 30. At least some of the internal structures of cylinder head 24 may be formed by casting. Coolant cavity lower surface 38 may be contoured, at least in part and typically entirely, by casting to form an igniter-support prominence 78. Igniter-support prominence 78 includes radially inward moat surface 80 extending circumferentially around axis 34. Coolant cavity lower surface 38 is also contoured, at least in part by casting, to form first coolant channel 70 and second coolant channel 74 each extending radially inward through igniter-support prominence 78 to radially inward moat surface 80. Coolant cavity lower surface 38 may be contoured as-cast, and radially inward moat surface 80 may be machined to form a machined wall surface. Various post-casting processing techniques can be used, however, in a practical implementation strategy coolant cavity lower surface 38 will retain the shape produced by casting. Surfaces of igniter post 62, and some surfaces of igniter-support prominence 78 will have shapes formed by machining originally cast surfaces. In an implementation, moat peripheral surface 80 is a machined surface, post inner surface 87 and post outer surface 86 are machined surfaces, moat floor surface 81 is a machined surface, first coolant channel 70 includes a first cast-in coolant channel, and second coolant channel 74 includes a second cast-in coolant channel. First coolant channel 70 may extend between a first two of intake ports 46 and exhaust ports 48 and second coolant channel 74 may extend between a second two of intake ports 46 and exhaust ports 48. In the illustrated embodiment, first coolant channel 70 extends between a first intake port 46 and a first exhaust port 48 and second coolant channel 74 extends between a second intake port 46 and a second exhaust port 48. In other embodiments, different coolant channel arrangements relative to intake ports and exhaust ports could be implemented.

INDUSTRIAL APPLICABILITY

Referring to the drawings generally, during operating internal combustion engine system 10 a mixture of a gaseous fuel and air will be conveyed into combustion cylinders 16. The gaseous fuel could be introduced into a stream of intake air upstream of a turbocharger compressor, for example, or injected into a stream of intake air at a location downstream of a turbocharger compressor, such as into an intake manifold or into intake runners each extending to one of combustion cylinders 16. At an appropriate timing, spark plug igniter 100 can be energized to produce a prechamber ignition charge of combusting fuel and air that is conveyed into an associated combustion cylinder 16 to ignite a main charge of gaseous fuel therein. Pistons 18 and engine valves 58 will move to effect an engine cycle, typically a four-stroke engine cycle, causing crankshaft 20 to rotate.

As noted, operation of internal combustion engine system 10 can produce significant heat. A liquid coolant, such as engine coolant, water, et cetera, can be conveyed through coolant cavity 40 to exchange heat with exposed surfaces of cylinder head 24 within coolant cavity 40. As noted above, cylinder head 24 can be uniquely structured for passive cooling of an igniter. Accordingly, rather than a dedicated coolant conduit or other coolant feed passage to the vicinity of spark plug igniter 100 and igniter sleeve 65, coolant passages 70 and 74 may convey a flow of coolant that is not separately circulated from the coolant in coolant cavity 40 generally. It is believed the combination, arrangement and geometry of coolant channels 70 and 74 provides an optimal flow of coolant through cooling moat 64 along with the flow of coolant through the entirety of coolant cavity 40.

It will also be recalled that cylinder head 24 may be formed as a cylinder head casting, for instance an iron or iron alloy casting. Making cylinder head 34 can include forming, at least in part by casting, various features of cylinder head 24 including cylinder head upper surface 26, cylinder head lower surface 28 forming fire deck 30, and each of coolant cavity upper surface 36 and coolant cavity lower surface 38. Igniter bore 32 may also be formed by casting, but typically machined to final form. Analogously, igniter opening 63 could be cast-in, or machined through as-cast material. In any case, upper bore section 110 and lower bore section 112 may be shaped to final geometry and surface finish by machining, as may igniter opening 63 and other surfaces of igniter-support prominence 78 as described herein.

Making cylinder head 24 can also include contouring, by way of the casting process, lower coolant cavity surface 38 to form first cast-in coolant channel 70, second cast-in coolant channel 74, and igniter-support prominence 78 with each of first cast-in coolant channel 70 and second cast in coolant channel 74 extending radially inward toward axis 34 through igniter-support prominence 78 and terminating at coolant feed locations spaced radially outward of axis 34. Forming of cylinder head 24 by casting can also include forming intake conduits 42 and exhaust conduits 44 extending from side surfaces of cylinder head 24 to intake ports 46 and exhaust ports 48 formed in fire deck 30 as well as the various other internal structures and surfaces of cylinder head 24 that are shown and described.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A cylinder head comprising:

a cylinder head casting including a cylinder head upper surface, a cylinder head lower surface forming a fire deck, a coolant cavity upper surface, a coolant cavity lower surface, a coolant cavity formed in part by each of the coolant cavity upper surface and the coolant cavity lower surface, and intake conduits and exhaust conduits each extending through the coolant cavity to intake ports and exhaust ports, respectively, formed in the fire deck;

the cylinder head casting further having formed therein an igniter bore defining a bore center axis and extending downwardly from the cylinder head upper surface to the coolant cavity upper surface; and the coolant cavity lower surface is contoured to form an igniter-support prominence having a radially inward moat surface extending circumferentially around the bore center axis, and a first coolant channel and a second coolant channel each extending radially inward through the igniter-support prominence to the radially inward moat surface.

2. The cylinder head of claim 1 wherein the coolant cavity lower surface is contoured as-cast, and the radially inward moat surface includes a machined wall surface.

3. The cylinder head of claim 2 wherein the first coolant channel and the second coolant channel terminate, respectively, at a first coolant feed opening formed at least in part in the machined wall surface and a second coolant feed opening formed at least in part in the machined wall surface.

4. The cylinder head of claim 3 wherein:

the radially inward moat surface includes a moat floor surface: and a first machined edge and a second machined edge each formed in part in each of the machined wall surface and in part in the moat floor surface define the first coolant feed opening and the second coolant feed opening, respectively.

5. The cylinder head of claim 1 wherein the igniter-support prominence includes a moat peripheral surface facing an axial direction away from the fire deck and extending circumferentially around the bore center axis.

6. The cylinder head of claim 5 wherein the igniter bore includes an upper bore section originating at the cylinder head upper surface and terminating at the coolant cavity upper surface, and a lower bore section originating at the moat peripheral surface.

7. The cylinder head of claim 1 further comprising an igniter post projecting upwardly to the igniter bore and having an igniter opening formed therein, and the igniter post is radially inward of the igniter-support prominence and a cooling moat is formed between the radially inward moat surface and the igniter post.

8. The cylinder head of claim 1 wherein the first coolant channel extends between a first two of the intake conduits and exhaust conduits, and the second coolant channel extends between a second two of the intake conduits and exhaust conduits.

9. The cylinder head of claim 8 wherein the first coolant channel and the second coolant channel are arranged along a common axis intersecting the bore center axis.

10. The cylinder head of claim 1 wherein each of the first coolant channel and the second coolant channel forms a tapered throat enlarged in a radially inward direction through the igniter-support prominence and open in an axial direction away from the fire deck.

11. A cylinder head comprising:

a cylinder head casting including a cylinder head upper surface, a cylinder head lower surface forming a fire deck, a coolant cavity upper surface, a coolant cavity lower surface, and a coolant cavity formed in part by each of the coolant cavity upper surface and the coolant cavity lower surface;

the cylinder head casting further including an igniter bore extending downwardly from the cylinder head upper surface and defining a bore center axis;

the coolant cavity lower surface is contoured to form a radially inward moat surface extending circumferentially around the bore center axis, a first coolant channel and a second coolant channel, the first coolant channel and the second coolant channel each extending radially inward to the radially inward moat surface.

12. The cylinder head of claim 11 wherein the first coolant channel and the second coolant channel are arranged along a common axis intersecting the igniter bore center axis.

13. The cylinder head of claim 12 wherein intake ports and exhaust ports are formed in the fire deck, and the first coolant channel extends between a first two of the intake ports and the exhaust ports and the second coolant channel extends between a second two of the intake ports and the exhaust ports.

14. The cylinder head of claim 13 wherein each of the first coolant channel and the second coolant channel forms a tapered throat.

15. A cylinder head comprising:

a cylinder head casting including a cylinder head upper surface, a cylinder head lower surface forming a fire deck, a coolant cavity upper surface, a coolant cavity lower surface, and a coolant cavity formed in part by each of the coolant cavity upper surface and the coolant cavity lower surface;

the cylinder head casting further including an igniter bore extending downwardly from the cylinder head upper surface and defining a bore center axis; and the coolant cavity lower surface is contoured to form a first cast-in coolant channel and a second cast-in coolant channel each extending radially inward toward the bore center axis, wherein:

the cylinder head casting further includes a machined wall surface extending circumferentially around an igniter opening; and the first cast-in coolant channel terminates at a first coolant feed opening formed at least in part in the machined wall surface, and the second cast-in coolant channel terminates at a second coolant feed opening formed at least in part in in the machined wall surface.

* * * * *